US008807612B2

(12) United States Patent
Hagelskjaer

(10) Patent No.: US 8,807,612 B2
(45) Date of Patent: Aug. 19, 2014

(54) TRANSPORT DEVICE

(75) Inventor: Kenneth Sandal Hagelskjaer, Esbjerg (DK)

(73) Assignee: Global Gravity ApS, Esbjerg V (DK)

( * ) Notice: Subject to any disclaimer, the term of this patent is extended or adjusted under 35 U.S.C. 154(b) by 0 days.

(21) Appl. No.: 13/977,347

(22) PCT Filed: Jan. 23, 2012

(86) PCT No.: PCT/DK2012/050028

§ 371 (c)(1),
(2), (4) Date: Jun. 28, 2013

(87) PCT Pub. No.: WO2012/100778

PCT Pub. Date: Aug. 2, 2012

(65) Prior Publication Data

US 2013/0270847 A1 Oct. 17, 2013

(30) Foreign Application Priority Data

Jan. 24, 2011 (DK) ..... 2011 70036
Dec. 1, 2011 (DK) ..... 2011 70665

(51) Int. Cl.
*B66C 1/16* (2006.01)
*B65D 85/20* (2006.01)
*B65D 85/62* (2006.01)

(52) U.S. Cl.
CPC ..... *B65D 85/20* (2013.01); *B65D 85/62* (2013.01)
USPC ..... 294/67.3; 294/67.4; 211/60.1

(58) Field of Classification Search
USPC ..... 294/67.1, 67.3, 68.3, 67.4, 143, 82.1; 410/36, 40, 42; 206/443; 211/60.1, 211/59.4, 194; 248/68.1, 73, 74.1
See application file for complete search history.

(56) References Cited

U.S. PATENT DOCUMENTS

| | | | | |
|---|---|---|---|---|
| 2,354,919 | A * | 8/1944 | Elmer | 248/68.1 |
| 3,055,398 | A * | 9/1962 | Tunnessen | 248/61 |
| 4,427,191 | A * | 1/1984 | Hess | 269/43 |
| 4,610,362 | A | 9/1986 | Remp et al. | |
| 5,123,547 | A * | 6/1992 | Koch | 211/60.1 |
| 5,377,939 | A * | 1/1995 | Kirma | 248/68.1 |
| 5,433,322 | A | 7/1995 | Williams | |
| 7,080,864 | B2 | 7/2006 | Casteran | |
| 8,376,672 | B2 * | 2/2013 | Kovacs, Jr. | 410/47 |

FOREIGN PATENT DOCUMENTS

| | | |
|---|---|---|
| DE | 32 26 263 A1 | 1/1984 |
| DE | 94 14 666 U1 | 8/1995 |
| GB | 2 059 905 A | 4/1981 |

* cited by examiner

*Primary Examiner* — Paul T Chin
(74) *Attorney, Agent, or Firm* — Robert Mlotkowski Safran & Cole, P.C.; David S. Safran

(57) ABSTRACT

A transport device for securing elongated items during transport and storage has the new feature that the set of profiled beams includes at least three profiled beams, namely a first, a second and a third profiled beam, the profiled beams being built upon each other layer by layer and connected to each other in respective layers. Each layer of pipes or items is surrounded by two profiled beams which are fixed to each other by a joining arrangement. Thus, each layer is individually fixed, and only the uppermost layer in a packet of longitudinal items is loose during packing and unpacking. Advantageously, the profiled beams are removed one by one from the top of a packet with the longitudinal items, and the weight of the single parts handled never becomes greater than the weight of one profiled beam with joining arrangement.

10 Claims, 12 Drawing Sheets

TRANSPORT DEVICE

BACKGROUND OF THE INVENTION

1. Field of the Invention

The present invention concerns a transport device for securing elongated items during transport and storage, where a transport device includes at least two sets of profiled beams, where a set of profiled beams includes at least two or more profiled beams, and where each profiled beam includes a first end and a second end, an underside, a top side and to side faces, where a number of transverse cutouts are arranged at least at the underside and through the two side faces for bearing on and partially surrounding the elongated items, where a set of profiled beams include at least two profiled beams, namely a first and a second profiled beam, where a first profiled beam at least includes jointing means that are accessible from the top side, and where a second profiled beam is adapted for disposition immediately over the first profiled beam, and at least including downwardly projecting jointing means for engaging the jointing means at the top side of the first profiled beam.

2. Description of Related Art

Within, e.g., the oil industry, it is common to handle elongated items such as long cylindric pipes. Such pipes may, e.g., be drill pipes or casing pipes which at one end are provided with external screw thread and at the other end with a corresponding internal screw thread. It is thus possible to join such pipes into a theoretically infinitely long pipeline. In order to form such a pipeline there is a need for having a considerably number of pipes available. In order to ensure safety during transport and storage of such pipes, various kinds of containers and/or transport frames have been developed over time where the pipes are more or less fixed and thereby secured against inadvertent rolling or being displaced in other ways. By such solutions it is possible to stack up to several packets of pipes in transport frames upon each other and juxtaposed. At the same time, it is appreciably easier to handle these transport frames with crane equipment since a transport frame is a very well-defined size in which the individual pipes are fixed. Thus, there is no risk of a stack of pipes being displaced, exposing personnel to danger.

U.S. Pat. No. 7,080,864 B2 discloses a solution where pipes are fixed between profiled beams with cutouts corresponding to the external shape of the pipes. By this solution it is possible to dispose up to several layers of pipes upon each other as the layers are separated by profiled beams. When a packet of pipes is packed, fittings that fix the ends of respective profiled beams are mounted as the latter are provided with projecting means at the ends. The projecting means are passed into corresponding cutouts in the fitting and the upper profiled beam and the lower profiled beam are subsequently connected by a bolt or the like extending from the projecting means of the upper profiled beam to the projecting means of the lowermost profiled beam whereby the fitting is kept in position, and whereby the finished packet with pipes is finally fixed. Then the packet is ready for transport or storage. Transport will typically occur by use of crane equipment by which the packet is lifted to a ship or a lorry for further transport. If the drill pipes are to be stored, this is often done on a harbour area or in connection with an oil drilling facility. If the oil drilling facility is placed ashore, sufficient space may be present in some cases, but particularly on offshore oil drilling platforms there is an express need for storing packets with drill pipes in a minimum of space, and often with several packets placed closely together and in many layers upon each other. This storage is advantageously to occur so close to the place of application as possible in order thereby to avoid further transport.

However, by the prior art solutions for transport and storage of drill pipes and/or casing pipes there are some disadvantages. Some disadvantages appear during packing and some during unpacking. A particularly great disadvantage by a solution as described in U.S. Pat. No. 7,080,864 B2 is that in order to get access to the pipes, all layers in the packet concerned are so to say to be loosened, and thereby the entire packet becomes more unstable and potentially dangerous to work at. As packing and unpacking both include manual work, accidents may happen very easily. The reason for the fact that all pipes are loose as soon as the packet is opened is that the whole packet is held together by the fittings, but not the less due to the bolts connecting the uppermost profiled beams to the lowermost profiled beams. Furthermore, there may be problems with dismounting the fittings if more packets stand close to each other, why there is a practical need for spacing between the individual packets. In principle, a packet according to U.S. Pat. No. 7,080,864 B2 takes up more space than actually required since it is not possible to open it without having access to the sides of the packet.

The mentioned fittings are intended for lifting the packet and may, if other means for lifting are applied, be obviated. The need for space along the sides is minimised hereby, and the packets can be disposed close to each other. However, there is still the inexpedient fact that the entire packet is loosened when removing the bolts, and the associated hazards are still present. Moreover, by the prior art solutions it is not possible to roll pipes in the upper layer of a packet on the packet concerned or to the packet disposed at the side of the packet of pipes concerned. This can frequently be necessary and advantageous as the respective packets with pipes thus can be used from the top and down, irrespectively whether speaking of one, two, three or more juxtaposed packets. The reason that pipes cannot immediately be rolled on the top of a packet and possibly to another packet is that the profiled beams are made with cutouts in which the pipes are located. This is required to ensure that the whole pipe packet does not become too unstable when the packet is loosened by removal of the long bolts connecting the uppermost profiled beam with the lowermost profiled beam. Bolts, fittings and profiled beams are all to be removed as well and stored in disassembled condition, further impeding the work process.

SUMMARY OF THE INVENTION

The object of the invention is to indicate a transport device for storing and transporting elongated items which, e.g., can be massive tubular items, drill pipes or casing pipes, or other types of elongated profiled items. In the following, the term pipe and items will be used as a common term for the above mentioned types of elongated items without the item necessarily having to be a pipe. Such items may, e.g., be used in connection with drilling for oil where the need for space during transport as well as storage are minimised, where the pipes can be released from the transport device in a secure way, and where the possibility of manual handling of the individual pipes is increased compared with the prior art.

As mentioned above, the invention concerns a transport device for securing elongated items during transport and storage. The new feature of a transport device according to the invention is that the profiled beams include a longitudinal central part with a top side and an underside and with a front side and a back side, where two downwardly facing flanges and two upwardly facing flanges, respectively, extend from the front side and the back side, respectively, the flanges thus forming the side faces of the profiled beam, where a number of transverse cutouts are formed through the upwardly facing flanges at the top side of the profiled beam, where the depth of the transverse cutouts is less that the depth of the transverse cutouts through the downwardly facing flanges at the underside.

As mentioned in the introduction it is so that each layer of pipes or items is surrounded by two profiled beams which are fixed to each other by the mentioned jointing means. In this way, each layer is individually fixed and therefore only the uppermost layer in a packet of elongated items can be loosened. Hereby is achieved a markedly more stable solution as the underlying layer of items are fixed and thereby stabilised all the time. By a solution according to the invention is achieved the advantage that the profiled beams are removed one by one from the top of a packet with longitudinal items, and the weight of handled single items therefore never becomes greater than the weight of one profiled beam with jointing means. The mentioned downwardly projecting jointing means can be an integrated part of a profiled beam, but in a preferred embodiment they may be loose jointing means that are placed in the profiled beam itself.

In a preferred variant of a transport fitting according to the invention, the profiled beams may be constituted by a hollow and partly open profiled pipe, where the longitudinal central part of the profiled beam at sides, top and bottom appears as a longitudinal closed chamber from where the two downwardly facing and two upwardly facing flanges extend. The profiled beam may thus be with a central chamber which is open at the ends.

By having a lesser depth of the uppermost cutouts than the lowermost transverse cutouts, there is a better opportunity to move the tubular items manually from one position to another position without great effort. The fact that there are cutouts will ensure that a tubular item cannot easily roll on the top side of the profiled beams as a tubular item will be retarded by the cutouts, but due to the lesser depth it will be appreciably easier to roll a tubular item on a profiled beam according to the invention than on the prior art variants. Tubular items in the form of drill pipes or casing pipes will often be handled by machine by a so-called "pipe gripper" which is typically operated by a hydraulic crane, but it is very common for a person to be present, manually providing for bringing a drill pipe or casing pipe into position for the mentioned "pipe gripper".

Profiled beams according to the invention can advantageously be made of extruded plastic or aluminium profiles but may also be made other types of metal or suitable composite materials, e.g., fibre reinforced plastics, and which, e.g., can be made by pultrusion. Such a profiled beam can advantageously be made such that it has a self-weight between 10 and 20 kg, preferably with a weight below 15 kg. The shape of the transverse cutouts on the profiled beams may advantageously be made with a diameter corresponding to the diameter of certain elongated tubular items, but the cutouts can, however, also be made with a kind of universal shape that allows tubular items with different dimensions to be placed in a secure way in the transverse cutouts of the profiled beams.

A profiled beam according to the invention may be provided with a more or less solid central part, or with a hollow central part, but can also be with an H-shaped cross-section where there are two downwardly facing flanges and two upwardly facing flanges forming the side faces of the profiled beam.

In yet a variant of a transport device according to the invention, the profiled beam between the two upwardly facing flanges may at the top side have a central longitudinal cutout in which is arranged a resilient material with a stiffness which is less than the stiffness of the profiled beam and also less than the stiffness of the elongated tubular items for which transport device is suited, where the surface of the resilient material is at a level below or flush with the upper edge of the upwardly facing flanges on the profiled beam, where the transverse cutouts thus are at least partially covered by the resilient material. Several advantages are achieved by the resilient material. One of the advantages is that the tubular elements can be clamped securely between two profiled beams irrespectively of the existence of a small tolerance difference in the diameter of individual pipes, or that a pipe has become slightly oval and therefore is smaller or larger at the point where it is clamped between two profiled beams. This minor difference in the dimensions of the tubular items is absorbed by the resilient material which advantageously can be mounted such that it protrudes 1 to 5 mm in relation to the bottom of the transverse cutouts at the top side of the profiled beams. However, there is nothing to hinder the resilient material from being even thicker and with a thickness where, e.g., up to 20 mm protrudes relative to the bottom of the transverse cutouts at the top side of the profiled beams. Another advantage of the resilient material is that it acts as a kind of skid-proofing when tubular items are rolled at the top side of the profiled beams, whereby greater safety is achieved in connection with the manual part of handling the elongated items. Furthermore, the elastic material contributes to ensure a certain friction between item and profiled beam. The elastic material can be a solid or foamed, suitable polymeric material which has the required properties with regard to i.a. stiffness and wearability. The surface of the resilient material can in one embodiment be below the surface of the profiled beams whereas in another embodiment, it is flush with or above the top side of the profiled beam itself. This may depend on the stiffness of the resilient material in question.

The elastic material may, e.g., be short elements arranged at each transverse cutout, and these resilient elements may possibly be made with a dimensionally fixed plate part which is moulded or covered with, e.g., rubber. Such an element may advantageously be provided with fixing means for fastening in the longitudinal cutout between the two upwardly facing flanges. The fixing means may, e.g., be constituted by a hole for a screw with which the element is fastened to the bottom of the central longitudinal cutout, the method also capable of being applied irrespectively of whether short or long resilient elements are applied, each extending across one or more transverse cutouts.

In a preferred embodiment of a transport device according to the invention, between the central part of the profiled beam and the two upwardly facing flanges on the profiled beam there may be arranged a cutout for receiving the jointing means that are accessible from the top side of the profiled beam, also called the upper jointing means. The jointing means may advantageously be a bushing or the like which are adapted with means corresponding to the jointing means intended for engagement with the upper jointing means.

Irrespectively of the type used, the jointing means can be arranged between the ends of the profiled beam and the first of the transverse cutouts at each end of the profiled beam, but they may also be arranged between two of the transverse cutouts on the profiled beam. Thus there is nothing to prevent the jointing means from being arranged such that, e.g., there are two transverse cutouts between one end of the profiled beam and the jointing means.

In a particularly preferred variant of a transport device according to the invention, the jointing means arranged accessible from the top side of a profiled beam is constituted by a nut, preferably a nut with internal screw thread. Such a nut can be welded to the profiled beam but may also be constituted by a nut which is mechanically fixed to the profiled beam, e.g., by pressing the nut into a fit hole or mounting it in the said cutout in other suitable ways. The nut can be designed as a bushing with internal thread for engaging jointing means and with external screw thread and an external union nut for mounting the nut in the profiled beam. Furthermore, the said jointing means can be constituted by a threaded hole in the profiled beam itself, meaning that the upper jointing means are an integrated part of the profiled beam. In order to reinforce such a threaded hole, reinforcing members can be arranged at one or both sides of the wall in which the threaded hole is arranged.

In yet a preferred variant of a transport device according to the invention, the jointing means arranged accessible from the top side of a profiled beam can be arranged in a cutout having a size and shape relative to the jointing means such that the jointing means are movable in longitudinal direction and/or transverse direction of the profiled beam, and where the jointing means, e.g., are constituted by a nut. Such a nut may advantageously be arranged in an oblong hole and designed such that it can be displaced longitudinally, transversely, or obliquely relative to the profiled beam. The purpose of displacing the nut is to get access to tightening or loosening the downwardly projecting jointing means described below. By such a solution there is furthermore achieved the advantage that one can control if the downwardly projecting jointing means are correctly engaging the upper jointing means as a deficient engagement will cause that the displaceable nut cannot be moved into position but instead will knock against the wrongly mounted downwardly projecting jointing means.

Another embodiment of jointing means which is accessible from the top side of a profiled beam may include a transverse bushing where the transverse bushing is mounted in holes at the side face of a profiled beam such that the direction of the transverse bushing is transversely to the top side of the profiled beam, and where in this transverse bushing there is a threaded hole with a direction pointing perpendicularly up from the top side of the profiled beam. By such a solution, the downwardly projecting jointing means, e.g., a bolt, can easily be mounted in a cutout adapted for the purpose as the transverse bushing is only brought into position over the bolt head after placing the bolt. Such a solution in which a transverse bushing is applied will be mentioned more closely in the detailed description below.

A transport device according to the invention may therefore advantageously be designed such that in the area at the longitudinal central part of the profiled beam and the two downwardly facing flanges on the profiled beam there is arranged a cutout for receiving the downwardly projecting jointing means. These jointing means are adapted for mutual engagement with the above mentioned uppermost jointing means, thereby serving the purpose of joining two profiled beams such that they enclose a number of elongated items and thereby exert a clamping force on the items, thus securing the items.

In a particularly preferred embodiment of a transport fitting according to the invention, these jointing means arranged projecting downwardly from the underside of a profiled beam are constituted by a bolt. Such a bolt may advantageously be with a bolt head, a bolt shank and a threaded end corresponding to the above mentioned jointing means that are accessible from a top side of a profiled beam.

Since such a bolt is, so to say, to be mounted internally of the profiled beam, possibly in the hollow section of a profiled beam, it may be necessary to adapt the cutout in which the bolt is disposed in such a way that a bolt can be mounted from the end of a profiled beam. This can be provided by making the cutout as an oblong hole with a width substantially corresponding to the outer diameter of the bolt shank or threaded end and with a length allowing the bolt to be positioned without the shank or head of the bolt coming into contact with the other parts of the profiled beam. An example of a preferred solution will be described in the detailed part of the description with reference to the drawing. By making the cutout as an oblong hole there is furthermore achieved the option of moving the bolt in the cutout in order thereby to facilitate placing the bolt in the corresponding upper jointing means in an underlying profiled beam.

Such a bolt may, however, also be mounted in the cutout arranged for the purpose in the profiled beam through the cutout in which a nut is to be fitted. This is possible to do prior to mounting the nut as the required cutout for the nut is greater than the threaded hole of the nut itself, and which right away can be made with a size allowing the bolt head to pass through the actual cutout. The nut can then be mounted, and in this variant the bolt cannot be dismounted without dismounting the nut as well. By a solution as described here, there is achieved possibility of having the downwardly projecting jointing means disposed at other points than at the ends of the profiled beams as, e.g., a position between the outermost item and the items second from the end may also be an option.

By a displaceable nut as mentioned above it is also possible to mount a bolt through the cutout in which the nut is arranged when displaced away from where the bolt is to be placed. When the bolt is placed and tightened, the nut can be moved back and thus be in position for receiving a bolt from a profiled beam arranged above.

In a particularly preferred variant of a transport device according to the invention, the downwardly projecting jointing means are made with operating means for engaging a tool where the circumscribed circle on the operating means has a diameter which is less than the diameter of the inscribed circle in the jointing means accessible from the top side of the profiled beam. It is thus possible to operate the downwardly projecting jointing means through the upper jointing means which typically will be constituted by a nut. The above mentioned operating means can, e.g., be an internal hexagon, a torx slot, or another suitable recess in the bolt head. However, the bolt head may also be adapted with operating means of the type entirely or partly surrounded by a tool during operation. The important aspect of the operating means of the bolt is that they are to be operated via the opening provided in the uppermost operating means on the profiled beam. It is thus easy to access the downwardly projecting jointing means with current tools without having to handle and store, e.g., loose bolts or similar. The profiled beams can immediately be handled with the downwardly projecting bolts hanging in the mentioned oblong holes why handling becomes very simple.

In a further variant of a transport device according to the invention, the downwardly projecting bolt may advantageously include a bolt head and a threaded end where the bolt has a length allowing the extreme end of the latter to reach through a nut on an underlying profiled beam in the mounted condition, where a recess or a cutout for mounting a safety pin or cotter pin is provided at the threaded end of the bolt. Hereby it becomes possible to visually ensure that the bolt is sufficiently engaging the nut, making clear that the mounting of the profiled beam in question has been performed correctly. The said safety pin or cotter pin can be designed in such a way that it is clearly visible, which possibly can be achieved by using a signal colour. This may very well be combined with the signal pin or cotter pin having a size or be provided with visual signal means by which the work with controlling the performed securing can be immediately be performed by looking at respective ends of the profiled beams.

In a variant of a transport device according to the invention, a profiled beam may further include coupling means for coupling with lifting means, where the coupling means are arranged in connection with lifting bolts extending through an upper profiled beam and down and engaging an underlying profiled beam in a set of profiled beams. By such a solution is achieved the advantage that lifting a packet with elongated tubular items is not performed only in the upper profiled beam. By anchoring the lifting means themselves, being a chain slung or a wire connected to a crane, to a bolt or similar fixed to a profiled beam arranged under one or more layers of tubular items, the lifting is then not performed in the uppermost and downwardly projecting jointing means. The profiled beam to which lifting bolts are fixed thus acts as a base for the lifted object. An example of a solution can be a packet of three layers of elongated items where transport devices consisting of profiled beams are mounted under the lowermost layer and over all the layers, where lifting bolts are passed through holes/cutouts/recesses in the uppermost profiled beam and in the middle profiled beam, and where these lifting bolts engage coupling means in the lowermost profiled beam. In such a situation, all layers of items will be lifted in the said lifting bolts and on the lowermost profiled beam. In connection with a lifting bolt or other lifting means being passed through openings, holes or recesses in the profiled beams, these can be provided with reinforcing bushings or other reinforcing means whereby longer service life and greater strength for the profiled beams in question are achieved.

In a profiled beam for a transport device according to the invention, reinforcing ribs may be arranged with advantage between the downwardly projecting flanges by which the profile is added increased rigidity and strength. In such a reinforcing rib, or at or between two ribs, a bushing guiding the bolt vertically may advantageously be arranged. By using such guide bushings, increased certainty for precise positioning of a profiled beam above an underlying profiled beam is achieved, as it is not otherwise possible to get a bolt to engage a nut in an underlying profiled beam. At the same time it is ensured that it is easier to mount the lifting means in openings/holes/recesses adapted for the purpose in the profiled beams, as the former only can be mounted if the profiled beams are mounted rather accurately above each other. If the profiled beams are not arranged rather accurately above each other, the lifting means cannot be mounted, and the packet with longitudinal items is to be repacked.

In yet a variant of a transport device according to the invention, the profiled beams can be identical, irrespective of their mutual positions. Thus it is not necessary that a particular sorting of the means to be applied is to be done during the work of packing or unpacking elongated items, as, e.g., drill pipes or casing pipes. Since all the profiled beams forming part of a transport device are made identical, the work cannot be more easy, so to say. At the same time, it is possible to perform the work faster and more safely since there is no risk of using wrong profiled beams.

A transport device according to the invention is very suited for transporting and storing drill pipes and casing pips and other types of elongated items. A finished packet with items can readily be transported by lorry, ship or in other suitable ways to the site where the packet is to be used or stored. Such packets can be disposed close to each other without affecting the possibility of accessing the uppermost layers in the packet, and at the same time it is possible to stack up to several packets upon each other without giving rise to problems.

The invention is described in the following with reference to the drawings.

DETAILED DESCRIPTION OF THE INVENTION

In the explanation of the figures, identical or corresponding elements will be provided with the same designations in different Figures. Therefore, no explanation of all details will be given in connection with each single Figure/embodiment.

Figure 1:
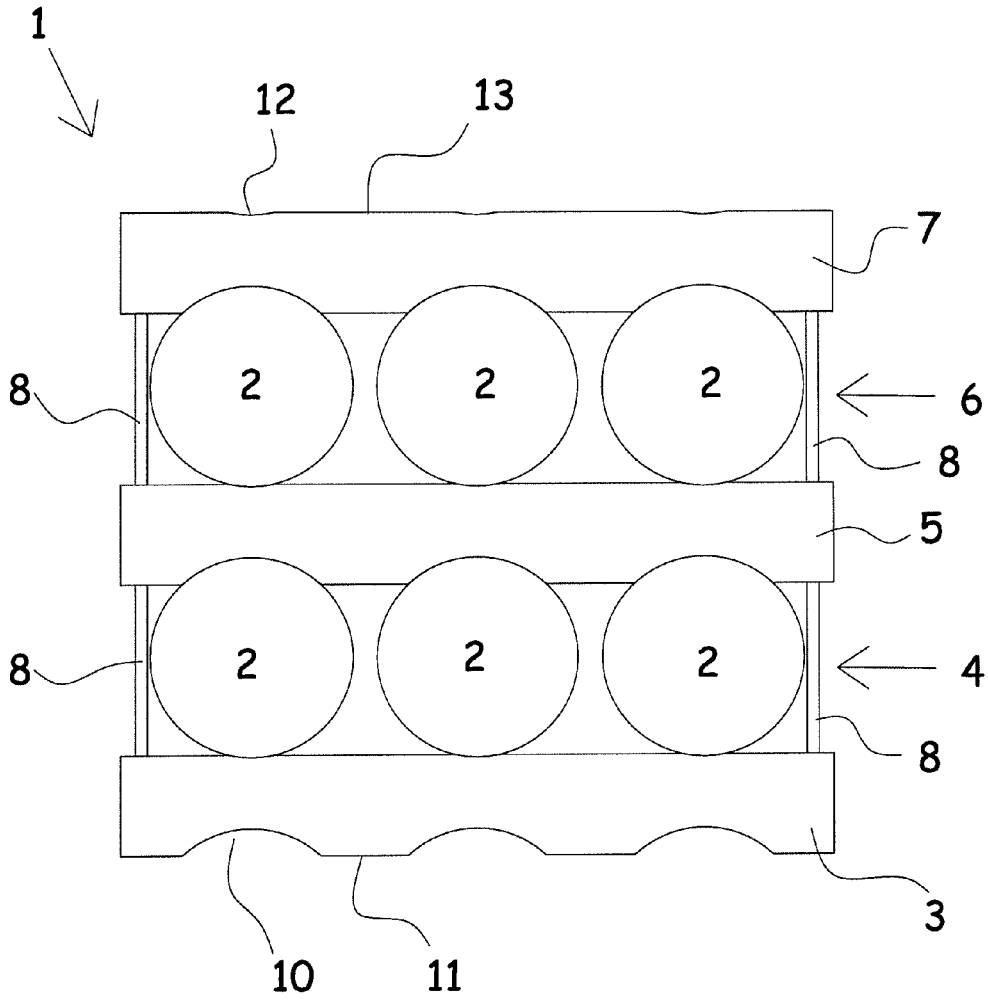
FIG. 1 shows a packet of pipes with transport device, as seen from the end.

In FIG. 1 is shown a packet 1 with six elongated tubular items 2 as seen from the end. The packet 1 includes a transport device according to the invention and consists of a first profiled beam 3 arranged under a first layer 4 of tubular items 2, a second profiled beam 5 arranged under a second layer 6 of tubular items 2, a third profiled beam 7 arranged over the second layer 6 of tubular items 2. Respective profiled beams 3, 5, 7 are identical and are fixed to each other by partly visible downwardly projecting jointing means 8 and not visible upper jointing means 9 (see FIG. 4). In the profiled beams there are transverse cutouts 10 with one size at the underside 11 and transverse cutouts 12 with another size at the top side 13 which in the shown variant corresponds to the diameter of the tubular items 2.

Figure 2:
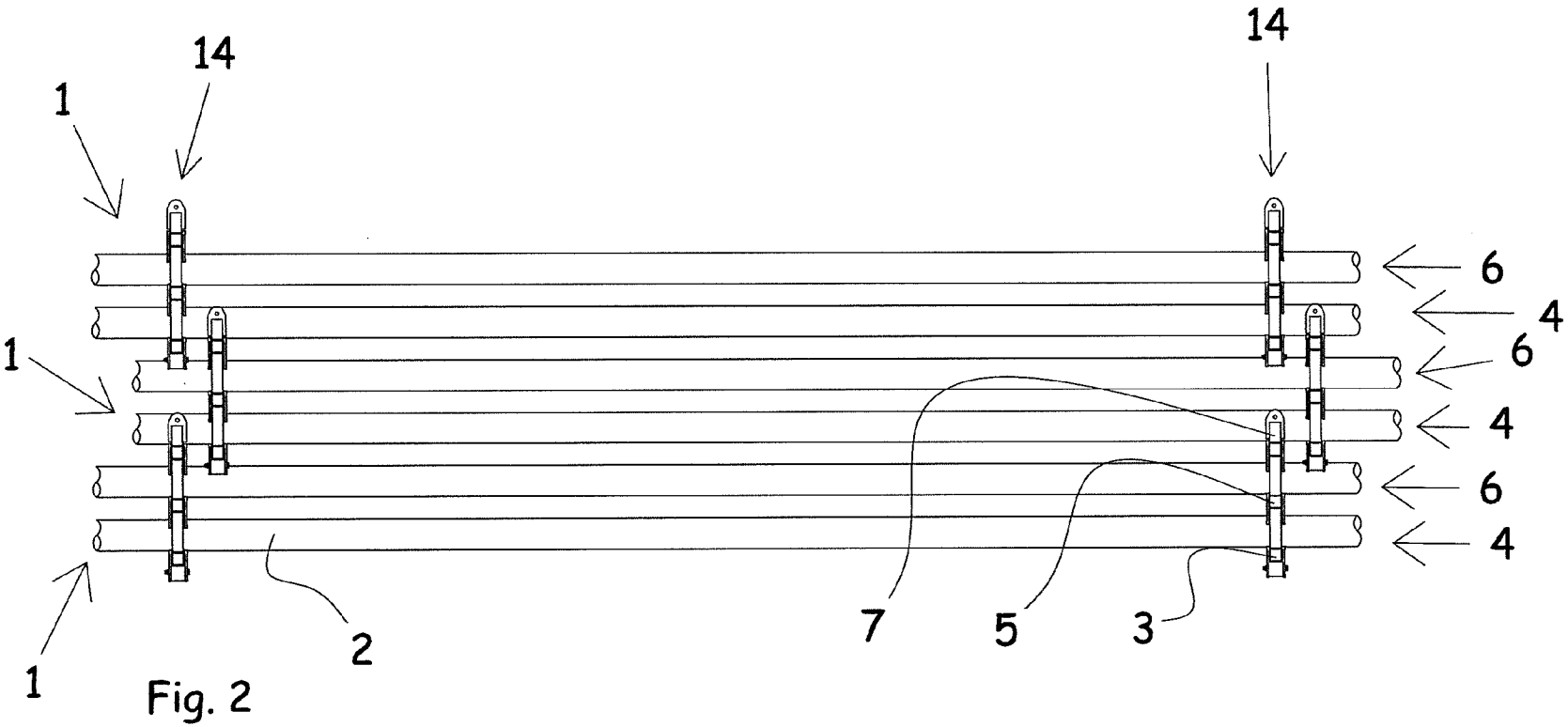
FIG. 2 shows three packets with pipes stacked upon each other, as seen from the side.

FIG. 2 shows three packets 1 of elongated tubular items 2 provided in transport device. These transport devices each include two sets 14 of profiled beams 3, 5, 7. The packets 2 are disposed upon each other, and as it appears on FIG. 2, the packets 2 can be stacked quite tight under the precondition that respective packets 2 are displaced with a spacing which is slightly greater than the width of a profiled beam 3, 5, 7. Since the profiled beams 3, 5, 7 are identical, the invisible cutouts 10 at the underside 11 of the profiled beam 3 fit down upon the tubular items 2 in the uppermost layer 6 in a second packet 2. In the same way, the tubular items 2 in the lowermost layer 4 in one of the uppermost packets 2 fit down into the transverse, not visible cutouts 12 at the top side 13 of the profiled beams 7.

Figure 3:
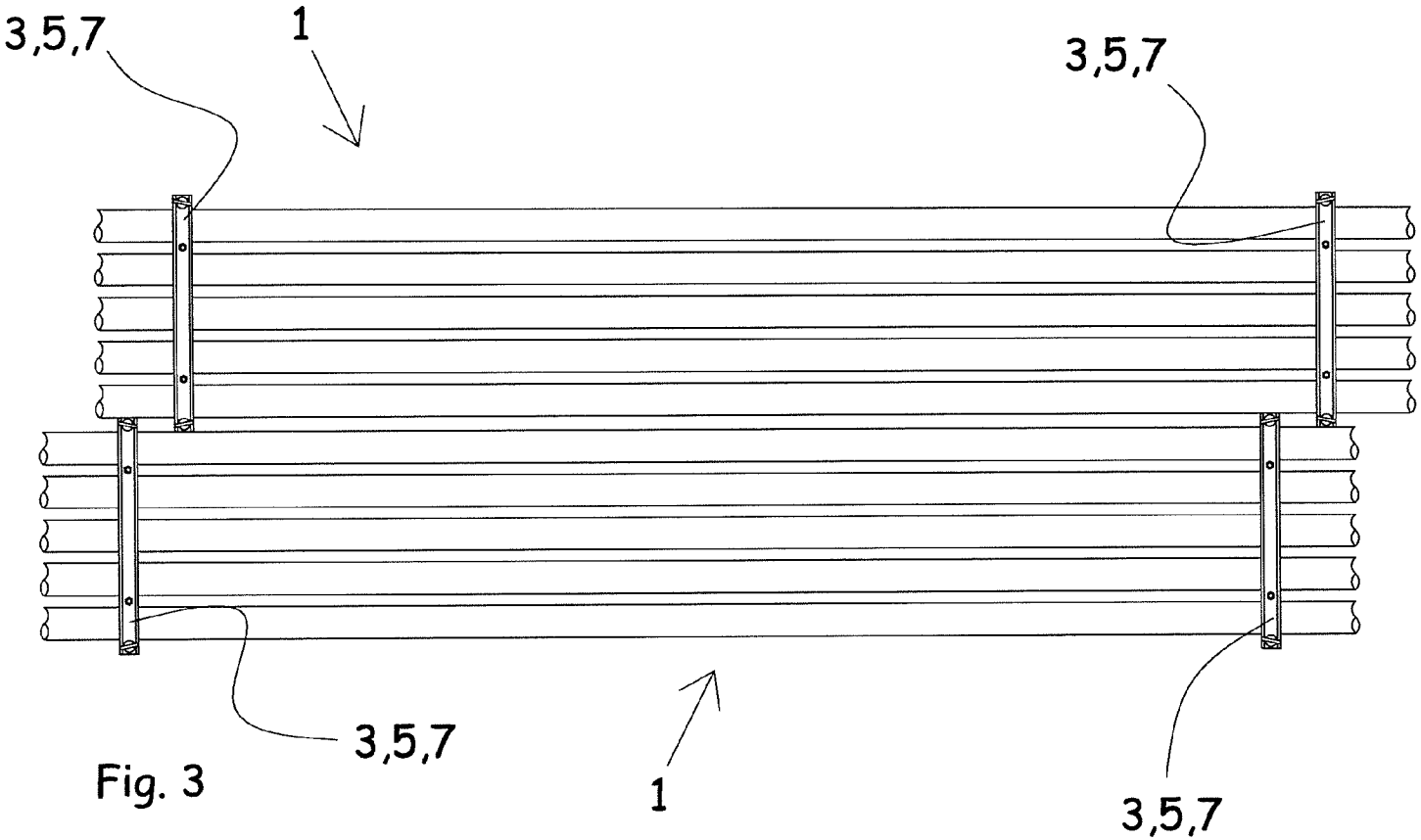
FIG. 3 shows two packets with pipes disposed side by side, as seen from above.

In FIG. 3, the same packets 1 as shown in FIG. 2 are seen, but from above where it is clearly seen that the two stacks of packets 2 can be disposed completely together as the ends of the profiled beams 3, 5, 7 are in direct contact with the adjacent packet 2.

Figure 4:
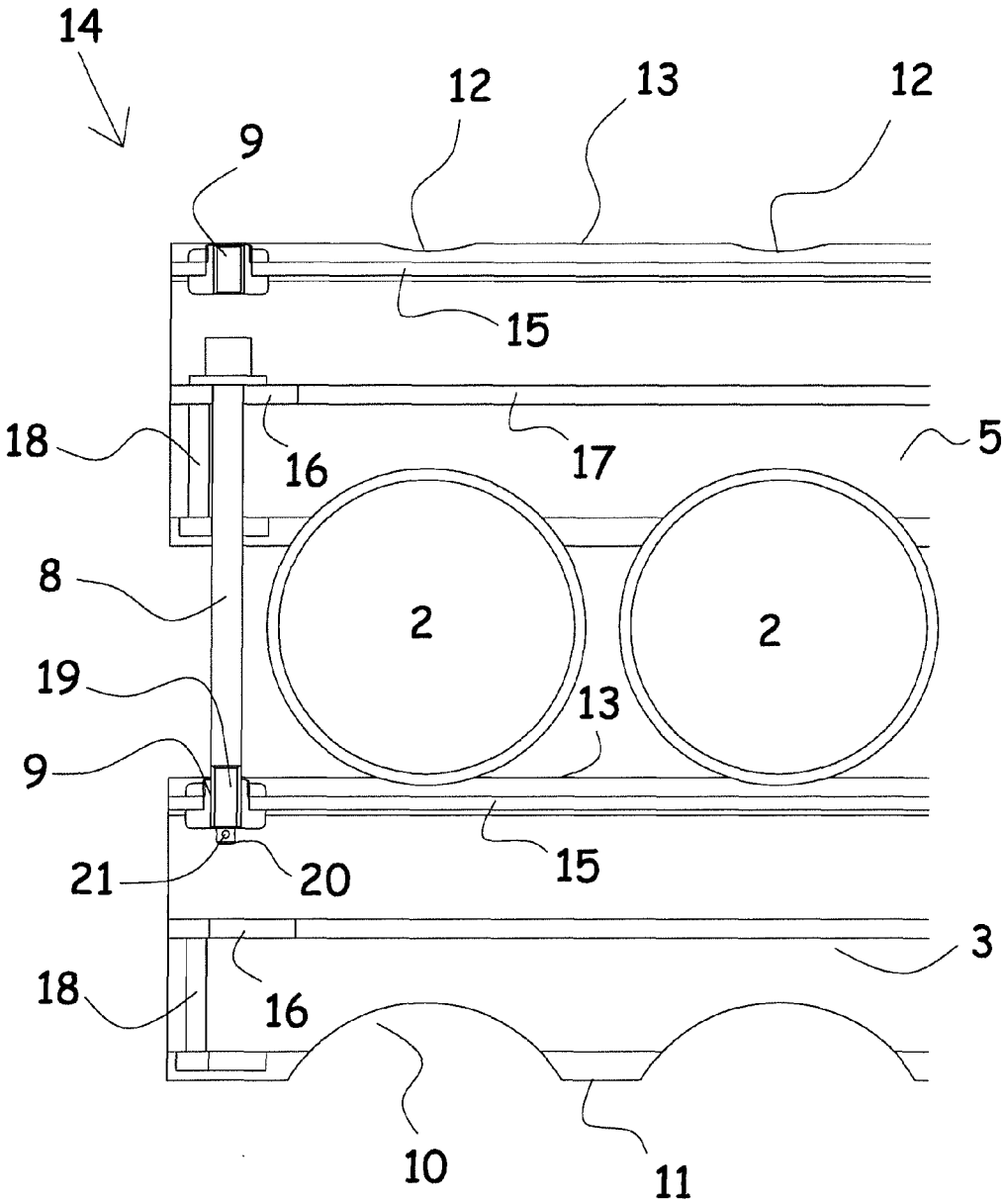
FIG. 4 shows details between two profiled beams.

FIG. 4 shows one end of a set 13 of profiled beams 3, 5 as seen in cross-section. Two tubular items 2 are here shown clamped between a lower profiled beam 3 and an upper profiled beam 5. At the top side 13 of the profiled beams there are transverse cutouts 12, and at the underside 11 there are transverse cutouts 10 as well. At the end of the profiled beams 3, 5 there are arranged upper jointing means 9 which are accessible from the top side 13 of the profiled beam. In the shown variant, the jointing means are constituted by a nut 9 with internal screw thread. The nut 9 is fixed to the profiled beam 3, 5 in a hole in an internal wall 15 in the profiled beam 3, 5. Furthermore, in the upper profiled beam 5 is also seen a downwardly projecting jointing means 8 in the form of a bolt 8. In the lower profiled beam 3, the bolt 3 appears engaging a nut 9 in the uppermost part of the underlying profiled beam 3. The bolt 8 is arranged in an oblong hole 16 in an internal wall 17 in the profiled beam 5. In the lower profiled beam 3, the oblong hole 16 is seen without a bolt 8. At the end of the profiled beams 3, 5 is furthermore seen a guide fitting 18 that facilitates positioning and mounting of the bolt 8 in the nut 9. At the threaded end 19, the bolt 8 is provided with a turned point 20 in which is arranged a through-going hole 21 for mounting a not shown safety pin or cotter pin.

Figure 5:
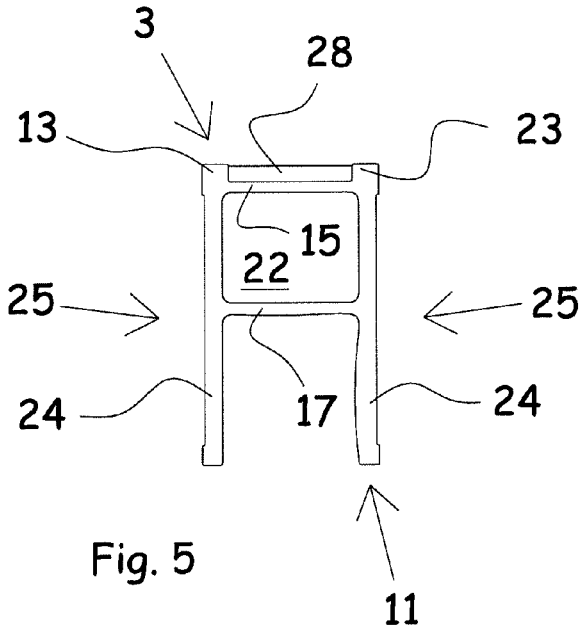
FIG. 5 shows a profiled beam as seen from the end and in cross-section with a cutout for pipes.

In FIG. 5 appears a profiled beam 3 in cross-section with a central closed chamber 22 with the two internal walls 15, 17 with two upwardly projecting flanges 23 and with two downwardly projecting flanges 24. The side faces 25 of the profiled beam is formed by these two flanges 23, 24 and the upper edge of the flanges 23 is the top side 13 of the profiled beam, whereas the lower edge of the flanges 24 is the underside 11 of the profiled beam. In the longitudinal cutout formed between the upwardly projecting flanges 23 there is arranged a layer 28 of rubber which is compressed to some degree when two profiled beams 3, 5 are clamped around a number of items 2.

Figure 6:
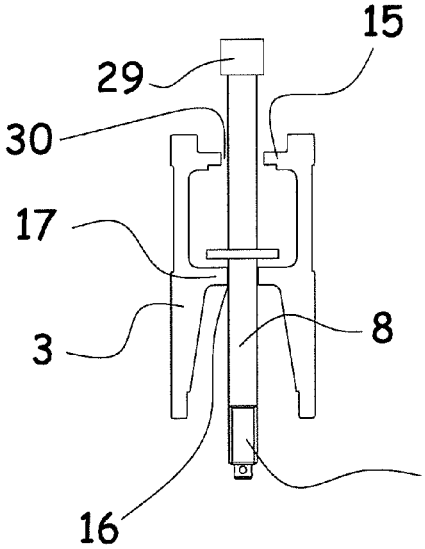
FIG. 6 shows a profiled beam where a bolt is mounted.

FIG. 6 shows how the downwardly projecting jointing means 8 are mounted in a profiled beam 3. The downwardly projecting jointing means 8 which are here constituted by a bolt 8 with a bolt head 29 and a threaded end 19 are arranged in the internal wall 17 of the profiled beam through the cutout 16.

Figure 7:
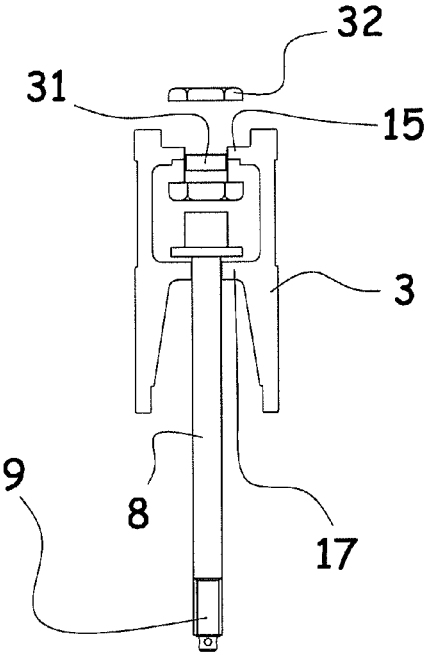
FIG. 7 shows a profiled beam where a nut is mounted.

In FIG. 7 appears how the nut 9 is subsequently mounted in the internal wall 15 in the cutout 30. The nut 9 is here designed as a bushing with internal thread for engaging the threaded end 19 of the bolt and with an external screw thread 31 and an external union nut 32 for mounting the nut 8 in the profiled beam 3.

Figure 8:
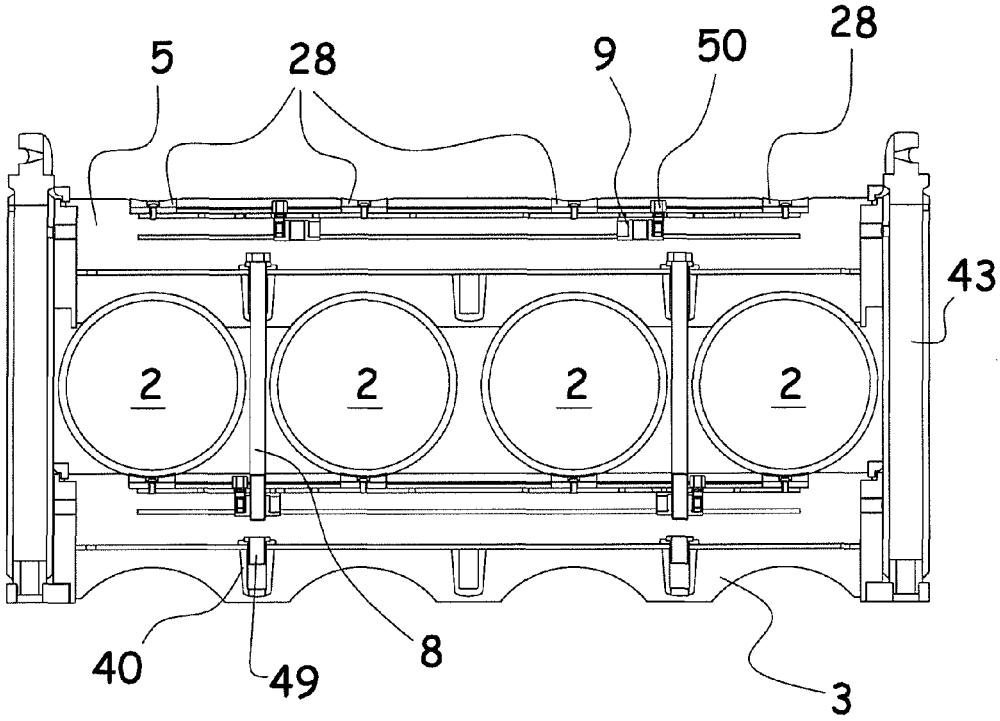
FIG. 8 shows a cross-section of two profiled beams mounted around one layer of elongated items.

FIG. 8 shows a cross-section of two profiled beams 3, 5 which are mounted around one layer of elongated items 2 where in the upper profiled beam 8 there is arranged upper jointing means 9 which are accessible from the top side 13 of the profiled beam (see FIG. 4). In the shown variant, the jointing means are constituted by a nut 9 with internal screw thread. The nut 9 is arranged displaceable in the profiled beam 3, 5 in a cutout in the top side of the profiled beam. The nut 9 is connected with a grip 50 which by manual operation can be displaced in the longitudinal direction of the profiled beam. In the shown Figure, the nut 9 is displaced towards the centre of the profiled beam 5 whereby access to the bolt 8 is obtained. This access is used when the bolt 8 is to be mounted in the bushing 49, which is mounted in a guide tube 40, as well as when the bolt 8 is to be tightened or loosened. The guide tube may, however, be substituted with advantage by one or more ribs 40 extending between the flanges 24 (see FIG. 5). Hereby is achieved a marked reinforcement of the profiled beam 3, 5. When the bolt 8 is placed in the bushing 49 or in a guide tube 40, the nut 9 can be displaced again such that it is now disposed directly above the bolt 8.

Figure 9:
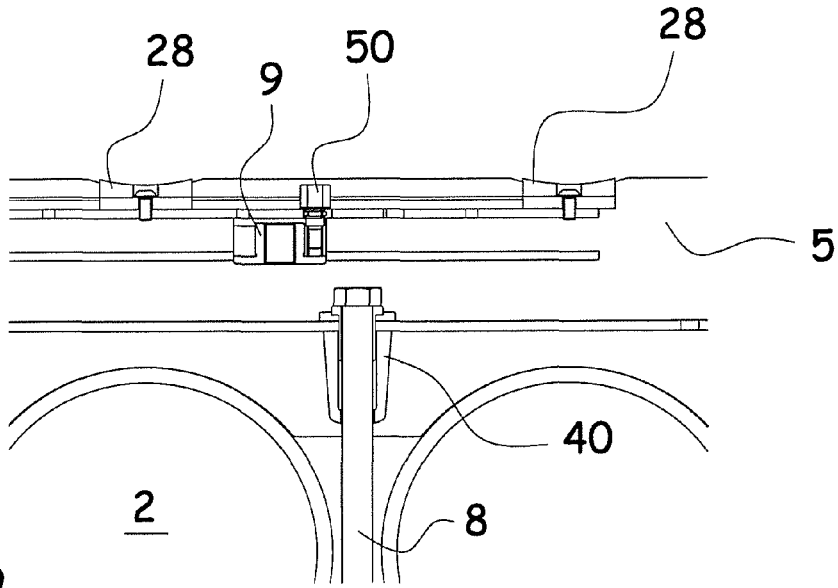
FIG. 9 shows a detail of a profiled beam with a displaceable nut as shown in FIG. 8.

FIG. 9 shows a detail of a profiled beam with a displaceable nut as shown in FIG. 8 where it clearly appears that short elements 28 are mounted with a concave resilient surface at each of the transverse cutouts 12 (see FIG. 1). Also, the nut 9 is seen clearly displaced to one side relative to the bolt 8.

Figure 10:
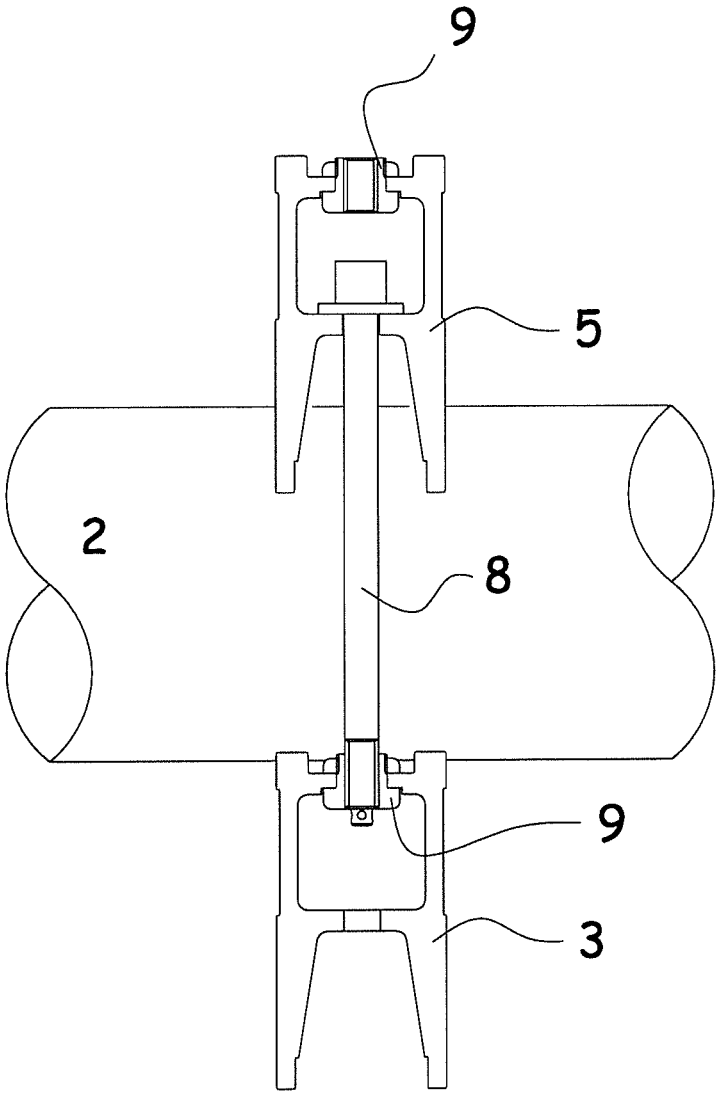
FIG. 10 shows a pipe between two profiled beams as seen from the end of the profiled beams.

FIG. 10 shows two profiled beams 3, 5 between which an elongated tubular item 2 is seen clamped by means of the downwardly projecting jointing means 8 and the upper jointing means 9.

Figure 11:
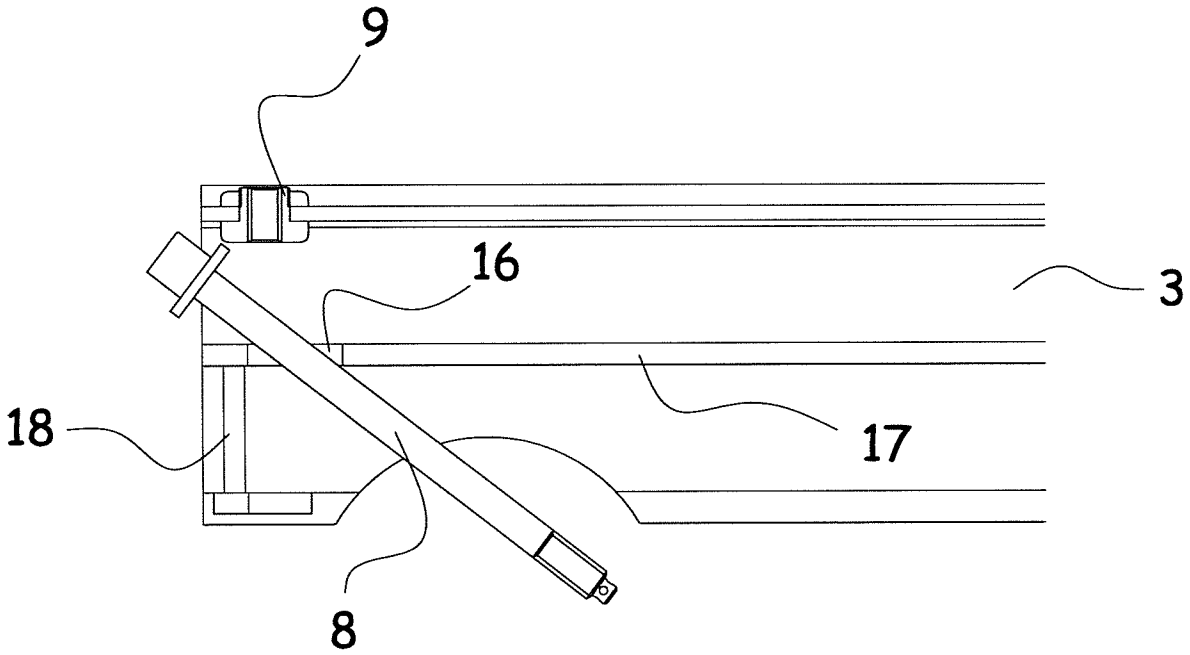
FIG. 11 shows how downwardly projecting fastening means are provided in a profiled beam.

FIG. 11 shows how the downwardly projecting jointing means 8 can be mounted in the cutout 16 adapted therefore in a profiled beam 3. Under the internal wall 17 appears a guide fitting 18 which has the purpose of holding the bolt 8 in a rather exact direction, by which joining with the nut 9 on another profiled beam 5 is facilitated.

Figure 12:
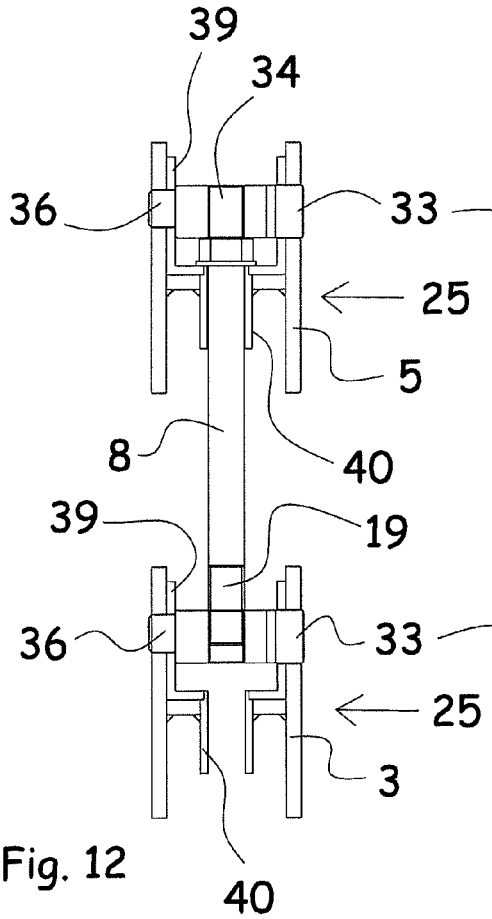
FIG. 12 shows a variant of the uppermost and downwardly projecting fastening means, as seen from the end.
Figure 13:
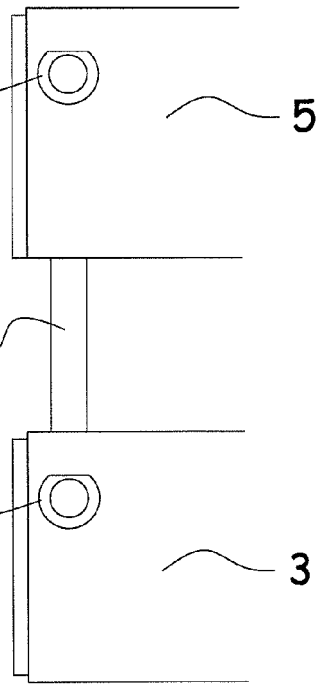
FIG. 13 shows, as in FIG. 12, a variant of the uppermost and downwardly projecting fastening means, but here seen from the side.
Figure 14:
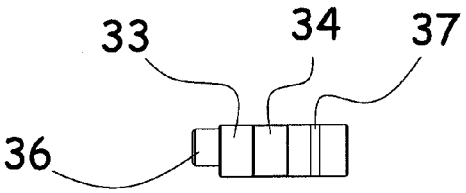
FIG. 14 shows a variant of the uppermost fastening means, as seen from the side.
Figure 15:
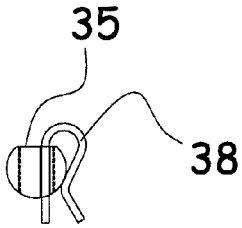
FIG. 15 shows a variant of the uppermost fastening means, as seen from the end.
Figure 16:
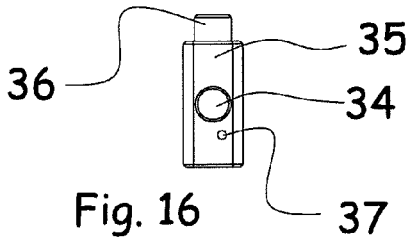
FIG. 16 shows a variant of the uppermost fastening means, as seen from above.

In FIGS. 12, 13, 14, 15 and 16 appears another variant of the invention where particularly the uppermost jointing means are made differently. In this solution is used a transverse bushing 33 which after placing the bolt 8 in the profiled beam 5 is mounted in a transverse cutout adapted for the purpose in the side faces 25 of the profiled beam 3, 5, 7. In this way it is ensured that the bolt 8 cannot fall out of the profiled beam 5 as the transverse bushing 33 is arranged immediately over the bolt head 29. The transverse bushing 33 is provided with a transverse threaded hole 34 for engaging the threaded end 19 of the bolt. In order to facilitate jointing of the bolt 8 and the transverse bushing 33, it may advantageously be provided with a plane surface 35 corresponding to the shape of the transverse cutout in the profiled beam 5 where the transverse bushing 33 is to be mounted. Hereby it is ensured that the transverse bushing 33 is always positioned correctly. The transverse bushing 33 may advantageously, as shown in this Figure, be reduced in diameter at one end 36 and with a through-going bore 37 for a safety pin 38 or similar. In this way, the transverse bushing 33 is kept in place and is thus readily accessible with the threaded end 19 of the bolt. Internally of the profiled beam 5 is shown a reinforcing insert 39 which advantageously can be arranged in immediate vicinity of the transverse bushing 33. The insert 39 can be welded or glued into the profiled beam, or be fixed in other ways. As shown in FIG. 12, the insert may include a guide tube 40 for the bolt 8.

Figure 17:
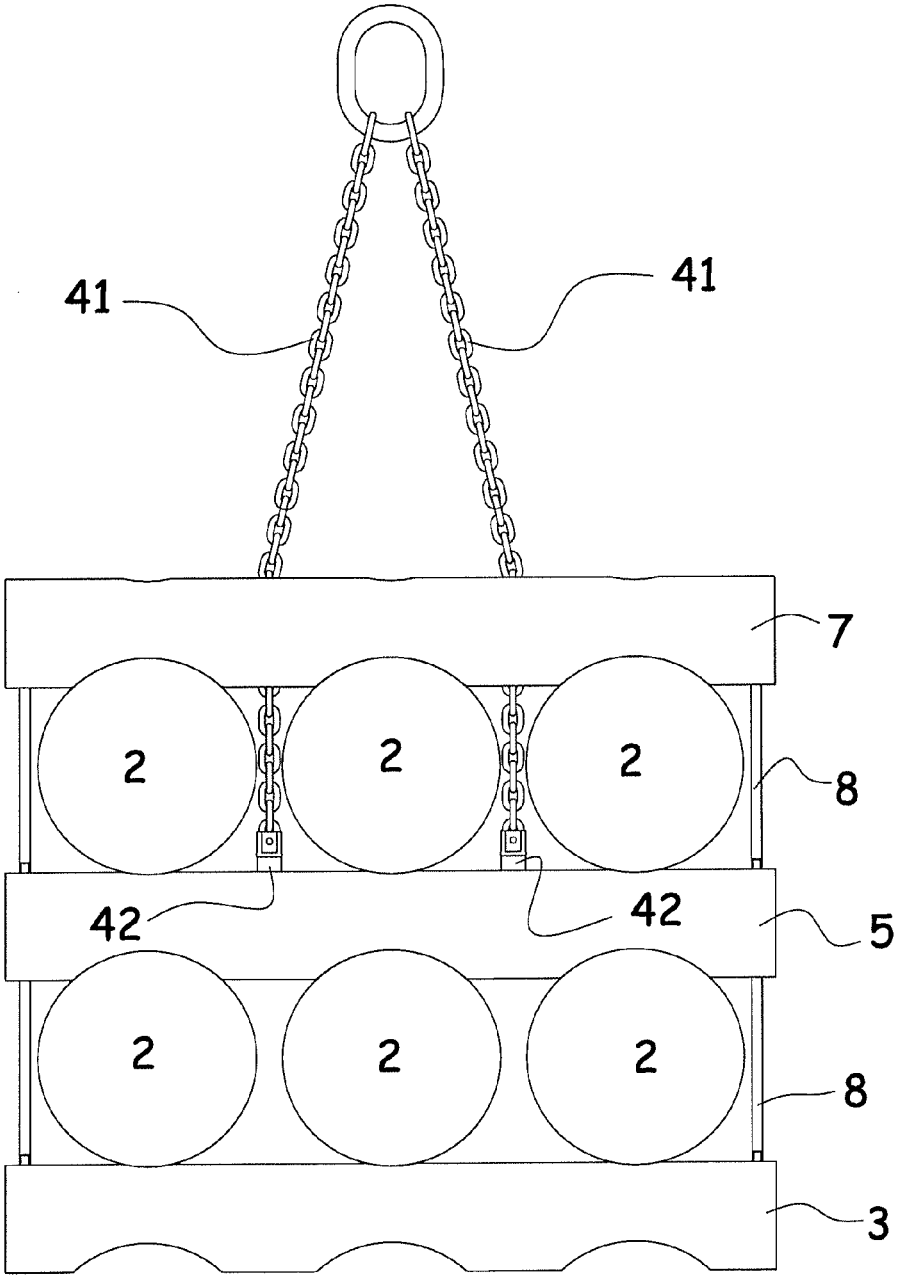
FIG. 17 shows a possible embodiment of lifting equipment for a pipe packet.

FIG. 17 shows a packet 1 with two layers of items 2, at which lifting equipment in the form of two chains 41 are coupled to the middle profiled beam 5. At the ends of the chains 41, coupling means 42 are mounted which can engage the profiled beam 5 and which can be locked in this position before a lifting action. The chains 41 are passed through holes in the profiled beam 7 and could very well be passed through the profiled beam 5 and finally fixed to the lower profiled beam 3.

Figure 19:
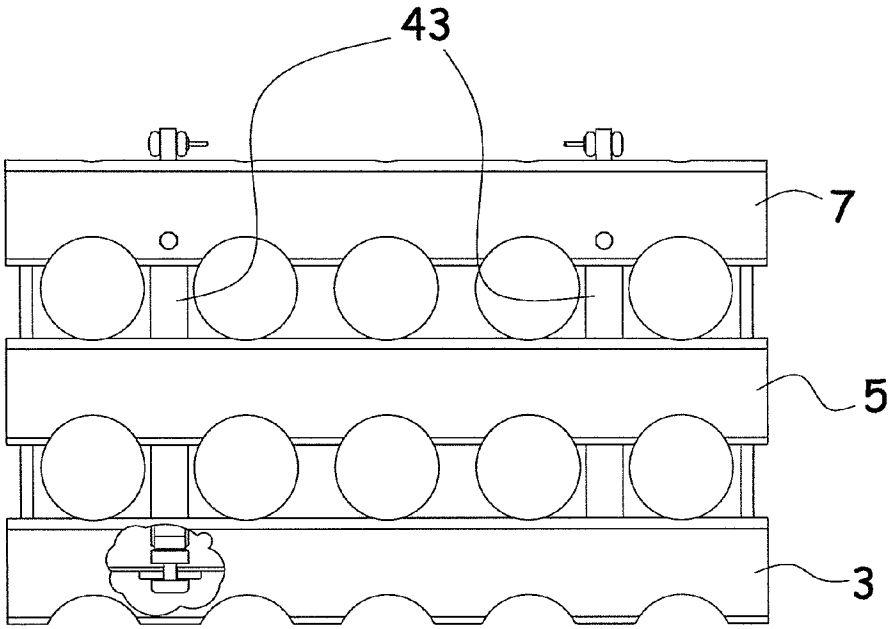
FIG. 19 shows, like in FIG. 18, another possible embodiment of lifting equipment for a pipe packet, as seen from the side.
Figure 18:
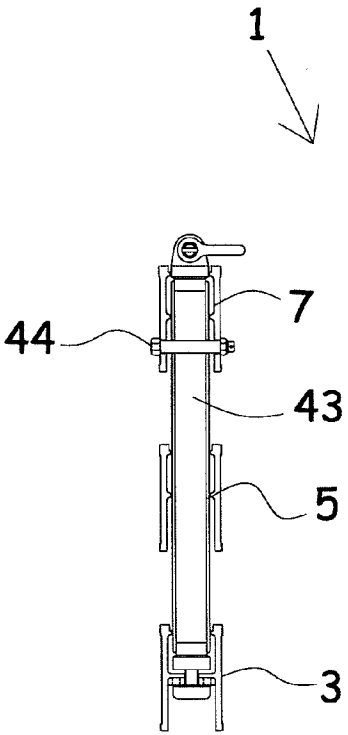
FIG. 18 shows another possible embodiment of lifting equipment for a pipe packet, as seen from the end.

In FIGS. 18 and 19 appears yet an optional way of lifting a packet 1. In this case, a lift bolt 43 is used which is connected to not shown lifting equipment and which is passed through openings in the profiled beams 3, 5, 7, engaging the lowermost profiled beam 3. In the upper profiled beam is arranged a locking bolt 44 which is passed through the lifting bolt 43 and which only can be mounted if the lift bolt 43 is in a locked and secured position in the profiled beam 3. This securing can be effected by turning the lift bolt 43 relative to the profiled beam 3, but may also occur by activating not shown locking means at the end of the lock bolt 43. These locking means can, e.g., be designed as a kind of anchor which by actuation are unfolded under the lowermost internal wall 17 in the profiled beam 3, 5, 7 and subsequently secured by a lock bolt 44, thereby preventing the anchor from folding and loosing its engagement. Such an anchor can be designed such that it engages one or more profiled beams 3, 5, 7 at once. In this way, all profiled beams 3, 5, 7 can be made with a uniform design whereby the work is considerably facilitated and a secure lifting can be performed.

Figure 20:
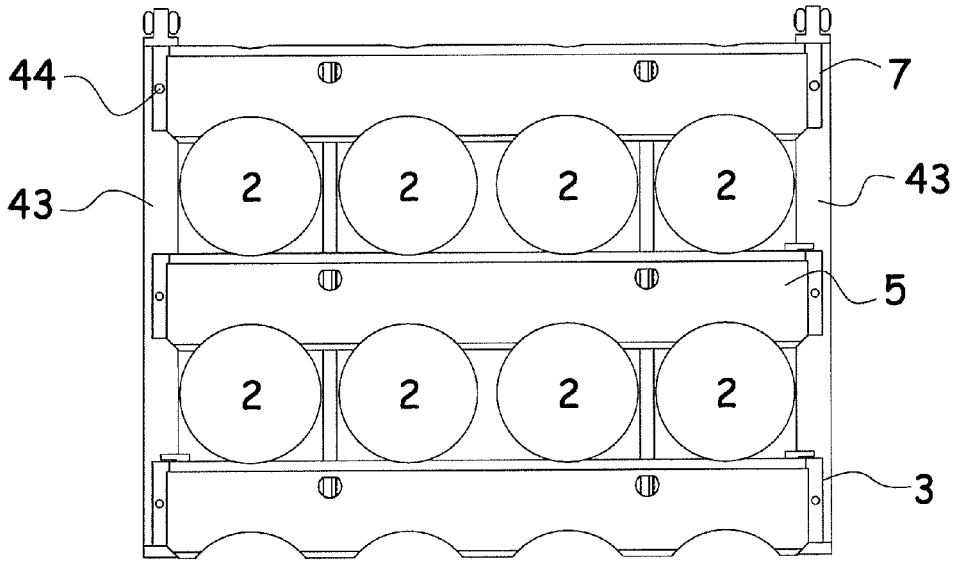
FIG. 20 shows yet a possible embodiment of lifting equipment for a pipe packet, as seen from the end of the pipe packet.
Figure 21:
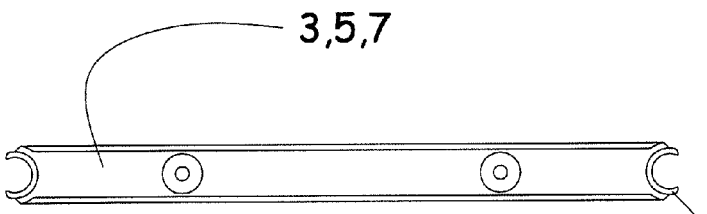
FIG. 21 shows, like in FIG. 20, another possible embodiment of lifting equipment for a pipe packet where a profiled beam is seen from above.
Figure 22:
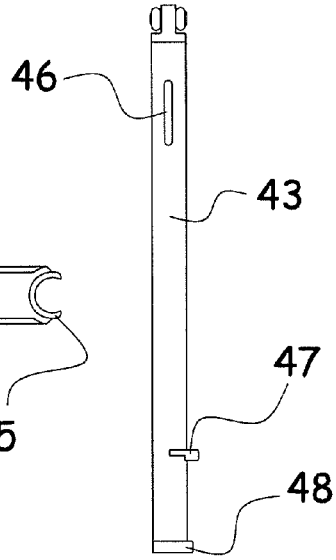
FIG. 22 shows a lifting bolt as also shown in FIG. 20.

FIGS. 20, 21 and 22 show yet a possible way of designing a lift bolt 43. In this variant, an open tubular profile 45 in which a lift bolt 43 is mounted from above is arranged at the end of the profiled beams 3, 5, 7. After mounting and positioning, the lift bolt 43 is rotated 180° about its longitudinal axis in the open tubular profile 45, and locking means 47 and 48 adapted therefore are brought into position over a top side and below an underside, respectively, of the profiled beam 3. The lift bolt 43 with the lock means 47 thus rests on the profiled beam 3 and can be secured in this position by providing a lock bolt 44. The lock bolt is passed through an opening adapted therefor in the open tubular profile 45 and through a cutout 46 in the form of an oblong hole in the lifting bolt 43. The oblong hole 46 has the effect that a certain lift bolt 43 can be used for packets 1 with items 2 with various diameters. In the shown embodiment, it is a packet 1 with items 2 with maximum diameter why the lock bolt 44 is at the upper end of the oblong hole 46. If the items 2 are with smaller diameter, the lock bolt 44 will be disposed closer to the lower part of the oblong hole 46. One and the same type of lift bolt 43 can thus be used for various sizes of items 2, which is an advantage.

In the illustrated embodiment, the lift bolts 43 engage the lower profiled beam 3 but could in principle engage the upper profiled beam 7 or the middle profiled beam 5. In this connection, the lock bolt 43 may right away be provided in a shorter or longer variant in order hereby to achieve a more optimal solution. Use of a lock bolt 43 which engages the lower profiled beam 3 provides a good, secure and stable lifting. A further advantage of the solution shown here is that the profiled beams 3, 5, 7 themselves appear as closed and thereby very stable profiles due to the open tubular profile 45.

What is claimed is:

1. A transport device for securing elongated items during transport and storage, where a transport device includes at least two sets of profiled beams, where a set of profiled beams includes at least two or more profiled beams, and where each profiled beam includes a first end and a second end, an underside, a top side and to side faces, where a number of transverse cutouts are arranged at least at the underside and through the two side faces for bearing on and partially surrounding the elongated items, where a set of profiled beams include at least two profiled beams, namely a first and a second profiled beam, where a first profiled beam at least includes jointing means that are accessible from the top side, and where a second profiled beam is adapted for disposition immediately over the first profiled beam, and at least including downwardly projecting jointing means for engaging the jointing means at the top side of the first profiled beam, characterised in that the profiled beams include a longitudinal central part with a top side and an underside and with a front side and a back side, where two downwardly facing flanges and two upwardly facing flanges, respectively, extend from the front side and the back side, respectively, the flanges thus forming the side faces of the profiled beam, where a number of transverse cutouts are formed through the upwardly facing flanges at the top side of the profiled beam, where the depth of the transverse cutouts is less that the depth of the transverse cutouts through the downwardly facing flanges at the underside.

2. A transport fitting according to claim 1, wherein the profiled beam is constituted by a hollow and partly open profiled pipe, where the longitudinal central part of the profiled beam includes a longitudinal closed chamber from where the flanges extend.

3. A transport device according to claim 1, wherein the profiled beam between the two upwardly facing flanges at the top side includes a central longitudinal cutout in which is arranged a resilient material with a stiffness which is less than the stiffness of the profiled beam, where the surface of the elastic material is at a level below or flush with the upper edge of the upwardly facing flanges on the profiled beam, where the transverse cutouts thus are at least partially covered by the resilient material.

4. A transport device according to claim 1, wherein between the central part of the profiled beam and the two upwardly facing flanges on the profiled beam there is arranged a cutout for receiving the jointing means that are accessible from the top side of the profiled beam.

5. A transport device according to claim 1, wherein the jointing means arranged accessible from the top side of said profiled beam are arranged in a cutout having a size and shape relative to the jointing means such that the jointing means are movable in longitudinal direction and/or transverse direction of the profiled beam, and where the jointing means e.g. is constituted by a nut.

6. A transport device according to claim 1, wherein in the area at the longitudinal central part of the profiled beam and the two downwardly facing flanges on the profiled beam there is arranged a cutout for receiving the downwardly projecting jointing means.

7. A transport device according to claim 1, wherein the jointing means arranged projecting downwardly from the underside of a profiled beam is constituted by a bolt.

8. A transport device according to claim 1, wherein the downwardly projecting jointing means are provided with operating means for engaging a tool where the circumscribed circle on the operating means has a diameter which is less than the diameter of the inscribed circle in the jointing means accessible from the top side of the profiled beam.

9. A transport device according to claim 1, wherein said profiled beam further includes coupling means for coupling with lifting means, where the coupling means are arranged in connection with lifting bolts extending through an upper profiled beam and down and engaging an underlying profiled beam in a set of profiled beams.

10. A transport device according to claim 1, wherein the profiled beams are identical, irrespective of their mutual position.

* * * * *